US007540065B2

(12) United States Patent
Zahuranec et al.

(10) Patent No.: US 7,540,065 B2
(45) Date of Patent: Jun. 2, 2009

(54) VACUUM CLEANER HANDGRIP

(75) Inventors: Terry L. Zahuranec, North Olmsted, OH (US); James L. VanMeter, Fairlawn, OH (US)

(73) Assignee: The Scott Fetzer Company, Westlake, OH (US)

( * ) Notice: Subject to any disclaimer, the term of this patent is extended or adjusted under 35 U.S.C. 154(b) by 618 days.

(21) Appl. No.: 11/324,966

(22) Filed: Jan. 3, 2006

(65) Prior Publication Data

US 2007/0151070 A1 Jul. 5, 2007

(51) Int. Cl.
*A47L 9/00* (2006.01)

(52) U.S. Cl. ..... 15/410

(58) Field of Classification Search ..... 15/410, 15/143.1–152.2, 329, 344, 350, 361
See application file for complete search history.

(56) References Cited

U.S. PATENT DOCUMENTS 4,249,281 A 2/1981 Meyer et al.
4,342,369 A * 8/1982 Ransom ..... 180/19.3
4,624,027 A 11/1986 Martin
6,061,869 A 5/2000 Ettes et al.
6,085,382 A * 7/2000 Bobrosky et al. ..... 15/350
6,108,862 A 8/2000 Frederick et al.
6,131,238 A 10/2000 Weber et al.
6,158,084 A 12/2000 Weber et al.
6,282,747 B1 9/2001 Morgan et al.
2004/0134018 A1 7/2004 Conner et al.
2004/0134019 A1 7/2004 Cipolla et al.
2004/0134020 A1 7/2004 Conner et al.
2004/0135537 A1 7/2004 Conner et al.
2007/0151073 A1* 7/2007 Cunningham ..... 15/410

* cited by examiner

*Primary Examiner*—Dung Van Nguyen
(74) *Attorney, Agent, or Firm*—Jones Day

(57) ABSTRACT

A handle stem extends along an axis and has an axially extending slot. A handgrip extends circumferentially about the stem and the slot. A prong extends from the handgrip diametrically through the slot for the slot to channel movement of the prong relative to the stem along the axis.

9 Claims, 4 Drawing Sheets

VACUUM CLEANER HANDGRIP

TECHNICAL FIELD

This application relates to handles, particularly for floor cleaning devices.

BACKGROUND

A vacuum cleaner has a handle with a handgrip. A user grasps the handgrip to move the cleaner over a floor to clean the floor.

SUMMARY

A handle stem extends along an axis and has an axially extending slot. A handgrip extends circumferentially about the stem and the slot. A prong extends from the handgrip diametrically through the slot for the slot to channel movement of the prong relative to the stem along the axis.

Preferably, the prong extends from one side of the handgrip to a diametrically opposite side of the handgrip. The prong is sized with respect to the slot to enable axial movement of the handgrip relative to the slot while preventing a transverse movement of the handgrip relative to the slot. The range of the axial movement of the prong is limited by abutment of the prong with axially opposite ends of the slot. The stem, the handgrip and the prong are parts of a cleaning device configured to be wheeled about a floor to clean the floor. There is a second axially extending slot in the stem, axially spaced from the first slot. The second prong extends from the handgrip diametrically through the slot for the slot to channel movement of the second prong relative to the stem along the axis.

DESCRIPTION

Figure 1:
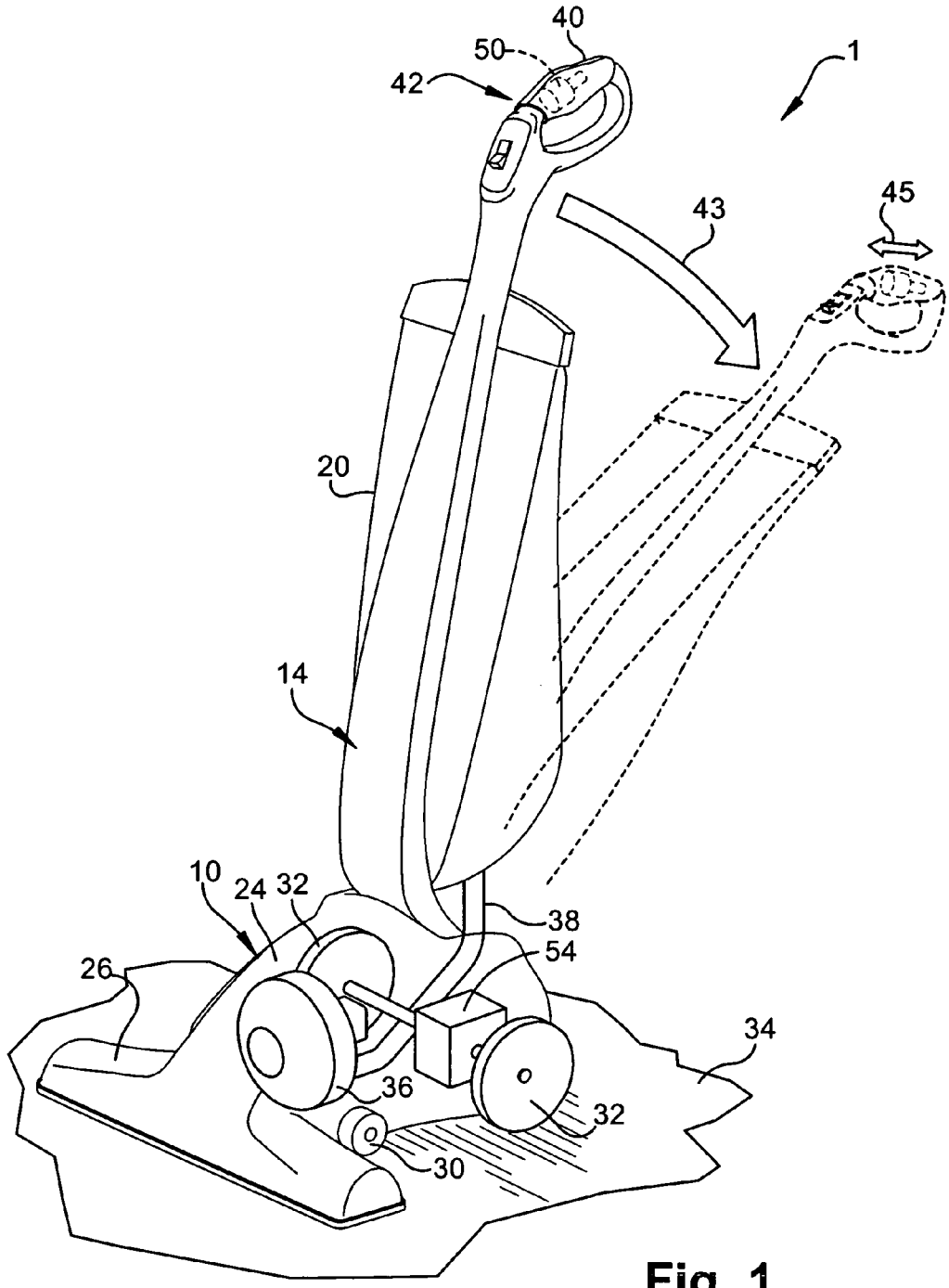
FIG. 1 is a schematic perspective view of a vacuum cleaner including a handle.

The apparatus 1 shown in FIG. 1 has parts that are examples of the elements recited in the claims. The apparatus 1 thus includes examples of how a person of ordinary skill in the art can make and use the claimed invention. It is described here to meet the requirements of enablement and best mode without imposing limitations that are not recited in the claims.

The apparatus 1 is a vacuum cleaner. It includes a base 10, a handle 14 extending upward from the base 10, and a filter bag 20 suspended from the handle 14. The base 10 has a nozzle 26, and also front and rear wheels 30 and 32 for wheeling the base 10 over a floor 34. A fan 36 in the base 10 generates a flow of air that carries dirt from the floor 34, through the nozzle 26, the fan 36 and a fill tube 38, into the filter bag 20. The handle 14 includes a handgrip 40 in its upper section 42.

To propel the cleaner 1 along the floor 34, a user grasps the handgrip 40 and pivots the handle 14 rearward (arrow 43). The user applies a force (arrow 45) to the handgrip 40 to push the base 10 forward or pull the base 10 rearward. A force sensor 50 in the handgrip 40 outputs a signal indicative of the direction and magnitude of the force applied to the handle 14.

A drive assembly 54 in the base housing 24 receives the signal. It rotates the rear wheels 32 in a direction and with a speed that respectively correspond to the direction and magnitude of the force applied to the handle 14, to assist the user in propelling the base 10 over the floor 34.

Figure 2:
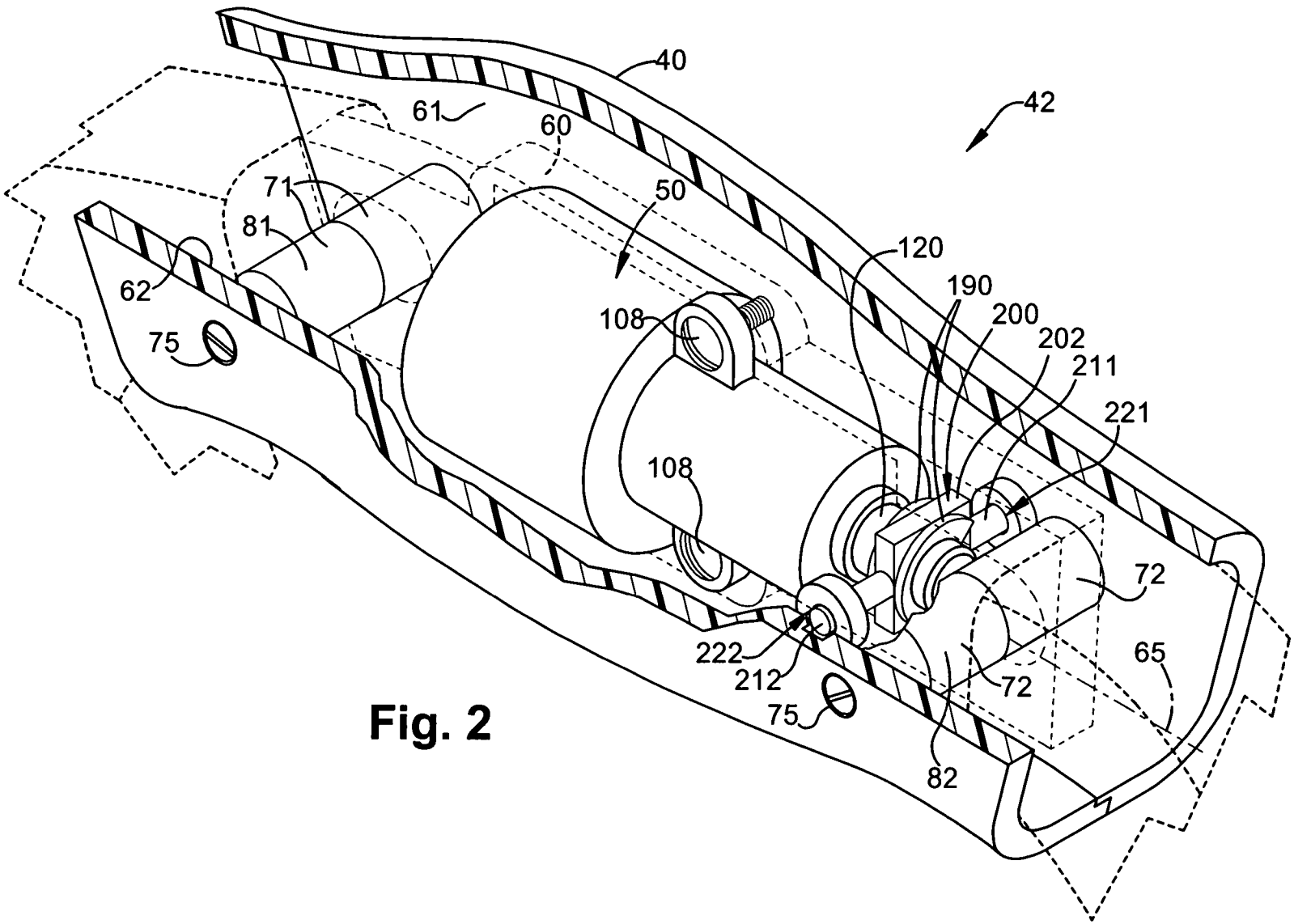
FIG. 2 is a breakaway view of an upper portion of the handle.
Figure 3:
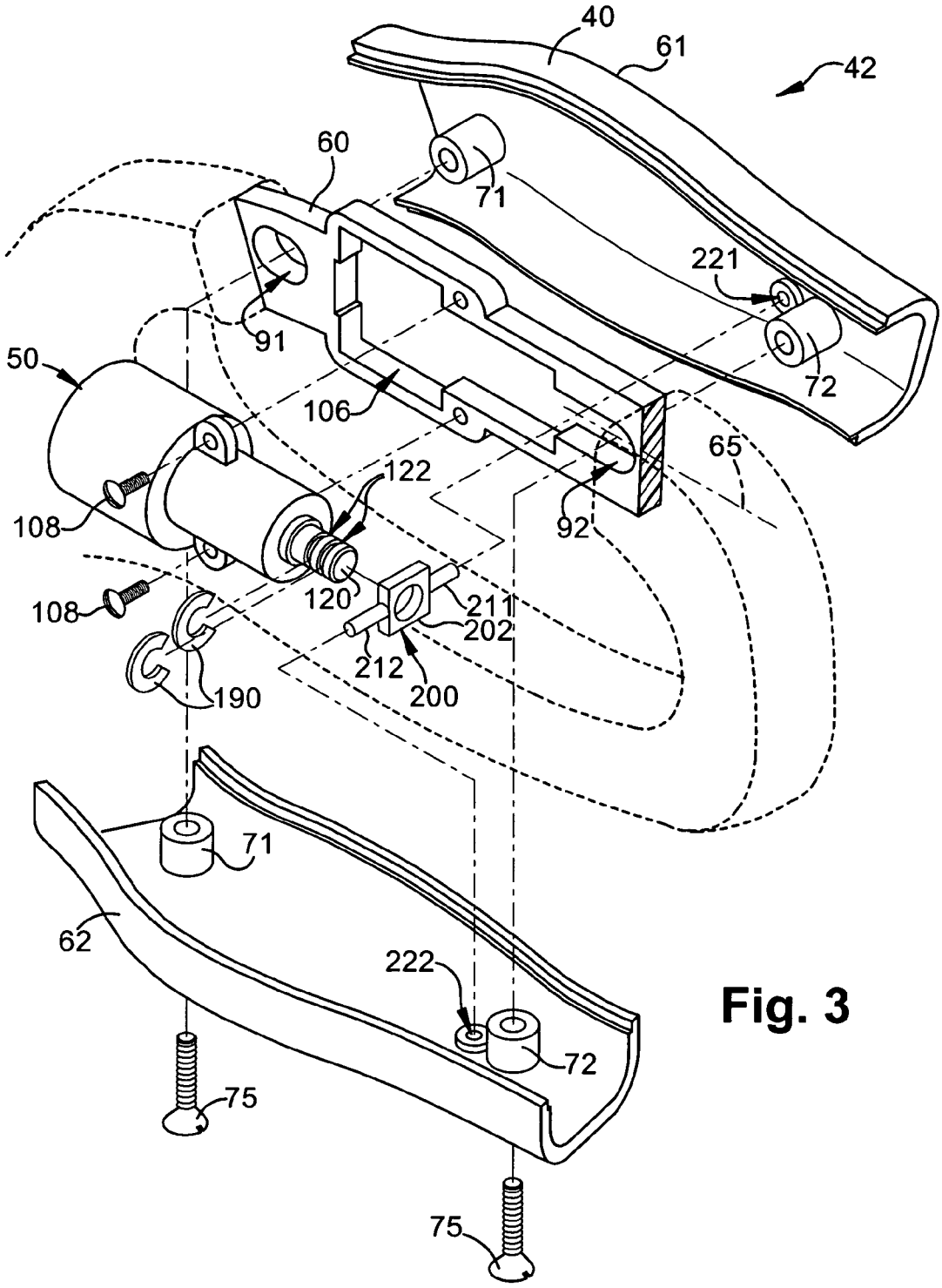
FIG. 3 is an exploded view of the upper portion of the handle.

The handle's upper section 42 is shown in FIGS. 2-3. It includes the handgrip 40 and a handle stem 60. The stem 60 is in the form of a metal bar extending along an axis 65. The handgrip 40 extends circumferentially (relative to the axis 65) about the stem 60 and is axially movable along the stem 60.

The handgrip 40 comprises two diametrically (relative to the axis 65) opposite side sections 61 and 62. Each side section 61 and 62 includes first and second tubular bosses 71 and 72. The first bosses 71 are aligned with each other, abut each other, and are secured together by a screw 75. The first bosses 71 together comprise a first prong 81 (FIG. 2) extending from one side 61 of the handgrip 40 to the diametrically opposite side 62 of the handgrip 40. Similarly, the second bosses 72 are aligned with each other, abut each other, and are secured together by a screw 75. The second bosses 72 comprise a second prong 82 extending from one side 61 of the handgrip 40 to the diametrically opposite side 62 of the handgrip 40.

Figure 4:
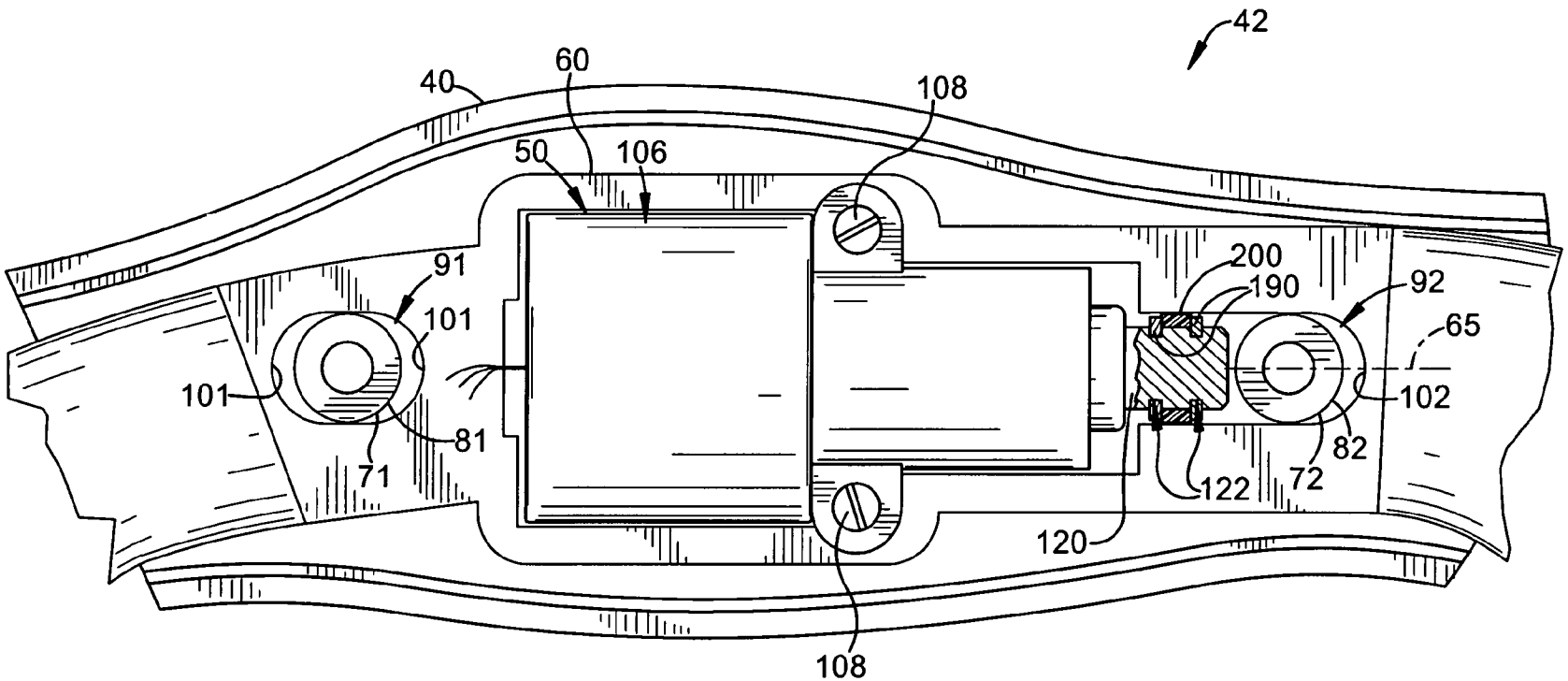
FIG. 4 is a sectional view of the upper portion of the handle.

As shown in FIG. 4, the first and second prongs 81 and 82 extend through corresponding first and second slots 91 and 92 in the stem 60. The slots 91 and 92 are elongated along the axis 65 and axially spaced from each other. They are hidden from the user's view by the handgrip 40 surrounding them. They are sized with respect to the prongs 81 and 82 to channel movement of the prongs 81 and 82 in the axial direction. This constrains movement of the prongs 81 and 82 and the handgrip 40 relative to the stem 60 to be in the axial direction. The slots 91 and 92 thus enable axial movement of the prongs 81 and 82 and handgrip 40 relative to the stem 60, while preventing a transverse movement of the prongs 81 and 82 and handgrip 40 relative to the stem 60. The range of axial movement is limited by abutment of the first prong 81 with axially opposite ends 101 of the first slot 91. The range is 0.03-0.3 inch and preferably about 0.1 inch. The first prong 81 abuts its rear slot end 101 when the second prong 82 abuts its rear slot end 102. The slot ends 101 are circular. Each is sized and shaped to abut the respective cylindrical prong 81 and 82 along a circular line of contact.

As shown in FIG. 3, the sensor 50 is located in a central slot 106 in the stem 60 and is fastened to the stem 60 by screws 108. It has an axially extending plunger 120 with two annular grooves 122. Two C-clamps 190 are clipped into the grooves 122 and closely capture a bracket 200. The bracket 200 includes a rectangular plate 202 that closely receives the plunger 120 and two cylindrical prongs 211 and 212 projecting in diametrically opposite directions from the plate 202. The prongs 211 and 212 are rotatably captured in respective pockets 221 and 222 in the respective handgrip sections 61 and 62. The bracket 200 thus couples the plunger 120 to the handgrip 40 for the plunger 120 to move in unison with the handgrip 40.

As shown in FIG. 4, each prong 81 and 82 is elastically biased by the sensor 50 to a neutral position axially centered within the respective slot 91 and 92. In operation, as the user pushes the handgrip 40 forward, the handgrip 40 is displaced forward relative to the stem 60 by a distance proportional to the force on the handgrip 40. Conversely, as the user pulls the handgrip 40 rearward, the handgrip 40 is displaced rearward relative to the stem 60 by a distance proportional to the force on the handgrip 40. The signal output by the sensor 50 indicates the direction and distance of the displacement of the handgrip 40.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. An apparatus comprising:

a handle stem extending along an axis and having an axially extending slot;

a handgrip extending circumferentially about the stem and the slot;

a prong extending from the handgrip diametrically through the slot for the slot to channel movement of the prong relative to the stem along the axis; and a sensor connected to both the stem and the handgrip to measure a parameter of a force applied to the handgrip relative to the stem.

2. The apparatus of claim 1 wherein the prong extends from one side of the handgrip to a diametrically opposite side of the handgrip.

3. The apparatus of claim 1 wherein the prong enables axial movement of the handgrip relative to the slot while preventing a transverse movement of the handgrip relative to the slot.

4. The apparatus of claim 1 wherein the range of the axial movement of the prong is limited by abutment of the prong with axially opposite ends of the slot.

5. The apparatus of claim 1 wherein the stem, the handgrip, the prong and the sensor are parts of a cleaning device configured to be wheeled about a floor to clean the floor.

6. The apparatus of claim 1 further comprising a second axially extending slot in the stem axially spaced from the first slot, and a second prong extending from the handgrip diametrically through the second slot for the second slot to channel movement of the second prong relative to the stem along the axis.

7. The apparatus of claim 1 wherein the parameter is the direction of the force.

8. The apparatus of claim 1 wherein the sensor is connected to the handgrip by prongs rotatably captured in pockets of the handgrip.

9. The apparatus of claim 1 wherein the sensor is configured to bias the handgrip to an axially neutral position relative to the stem, from which the handgrip can be axially displaced by the force.

* * * * *